US007802339B2

(12) United States Patent
Kuivikko et al.

(10) Patent No.: US 7,802,339 B2
(45) Date of Patent: Sep. 28, 2010

(54) SIDE BRUSH

(75) Inventors: Reijo Kuivikko, Tampere (FI); Kimmo Sajakorpi, Tampere (FI)

(73) Assignee: Sajakorpi Oy, Tampere (FI)

( * ) Notice: Subject to any disclaimer, the term of this patent is extended or adjusted under 35 U.S.C. 154(b) by 896 days.

(21) Appl. No.: 11/675,414

(22) Filed: Feb. 15, 2007

(65) Prior Publication Data

US 2007/0130712 A1 Jun. 14, 2007

Related U.S. Application Data

(63) Continuation of application No. 10/537,961, filed as application No. PCT/FI2004/000003 on Jan. 8, 2004, now Pat. No. 7,203,987.

(30) Foreign Application Priority Data

Mar. 4, 2003 (FI) ..... 20030502

(51) Int. Cl.
*E01H 1/04* (2006.01)

(52) U.S. Cl. ..... 15/87; 15/180; 15/183; 15/198; 15/202

(58) Field of Classification Search ..... 15/87, 15/180, 183, 198, 202; *E01H 1/04*
See application file for complete search history.

(56) References Cited

U.S. PATENT DOCUMENTS

| | | | |
|---|---|---|---|
| 3,678,530 | A | 7/1972 | Horton et al. |
| 3,875,607 | A | 4/1975 | Rosseau |
| 4,236,269 | A | 12/1980 | Block |
| 4,302,863 | A | 12/1981 | Droeser |
| 5,819,357 | A | 10/1998 | Gould |
| 6,260,927 | B1 | 7/2001 | Sajakorpi et al. |
| 6,457,202 | B1 | 10/2002 | Torres et al. |
| 2003/0172484 | A1 | 9/2003 | Lendabarker |

FOREIGN PATENT DOCUMENTS

| | | | |
|---|---|---|---|
| FR | 2614188 | A1 | 10/1988 |
| WO | WO 9820773 | A1 | 5/1998 |

OTHER PUBLICATIONS

File history of U.S. Appl. No. 10/537,961.
Initial Publication with ISR for PCT/FI04/00003.
International Preliminary Report on Patentability Chapter for PCT/FI04/00003.
Written Opinion of the International Searching Authority for PCT/FI04/00003.
FI 20030502 (Priority Document for PCT/FI04/00003).

*Primary Examiner*—David A Redding
(74) *Attorney, Agent, or Firm*—Lathrop & Gage LLP

(57) ABSTRACT

Side brushes adapted to be mounted on a sweeping machine and operative as a brush about a rotation axis are disclose herein. The side brushes include a base element and a bristle segment. According to one embodiment, the base element has at least one outer edge and an elongate channel extending inwardly from a respective outer edge. The bristle segment has a plurality of bristles and a frame member. The frame member has a configuration complementary to a configuration of the elongate channel such that interaction between the frame member and the base element adjacent the elongate channel couples the bristle segment to the base element. Each bristle has a top end, and all of the bristle top ends are fused together to define the frame member.

19 Claims, 8 Drawing Sheets

SIDE BRUSH

RELATED APPLICATIONS

This application is a continuation application of U.S. patent application Ser. No. 10/537,961, filed Jun. 9, 2005 now U.S. Pat. No. 7,203,987, which is the National Phase Application of PCT/FI2004/000003, filed Jan. 8, 2004, which claims priority to Finish Patent Application Serial No. 20030502, filed Apr. 13, 2003, the disclosures of which are incorporated herein by reference.

BACKGROUND

Side brushes have been traditionally constructed by means of a base element, made for example from a flat plywood panel and having a radially sufficiently wide zone in its outer periphery extending from the center of the base element and provided with pairs of holes in an inclined position. Providing this type of side brush with bristles is effected by threading the bristles in one hole and out of the other, which is followed by clamping the bristles in place for example with a plywood or metal plate fastened to the back of the base element. A downside in this type of solution is particularly the inconvenience of its manufacture, since, first of all, a multitude of paired holes must be drilled in the base element, whereafter the bristles threaded therein must be further clamped in position by means of a back cover. Another notable drawback is that a side brush of the above type is a disposable item, because dismounting bristles from a base element is not economically viable but, instead, replacing the entire side brush with a new one is more convenient.

On the other hand, the implementation of a so-called cassette principle in the above-mentioned context is presently known. This type of side brush solutions include a base element, which is fabricated e.g. of a rather thin metal sheet by form-bending, such that it is provided with a coupling system in a position inclined relative to the mounting plane of a side brush, which enables a detachable anchoring thereto of bristle segments manufactured in a prefabrication stage. The bristle segments used in this instance are currently manufactured in such a way that the bristles are bound together at one end thereof e.g. by a form-bendable base element of sheet metal, which is slippable in slots functioning as a coupling system. One optional solution in this respect is e.g. such that the base element is provided with holes through which the bristles are threaded, whereafter the base element's back face is fitted with an appropriate clamping plate for securing the bristles in place. Another alternative solution is described in U.S. Pat. No. 3,678,530, wherein the frame member holding each bristle segment together is constituted by a three-component frame structure, which is then secured to the base element of a side brush.

This type of solutions, based on a so-called cassette principle, are not currently very functional either, firstly due to the fact that the fabrication of bristle segments is laborious and expensive because, first of all, the positioning of bristles in place requires an unacceptable amount of manual labour, in addition to which the bristles must, on the other hand, be manufactured with a quite high dimensional precision in order to fit the same in a respective coupling system by applying a force as little as possible. In practice, however, this causes all sorts of problems in an installation process because of rather large manufacturing tolerances existing in this type of construction for natural reasons. On the other hand, solutions of the above type do not enable recycling or the reuse of bristle segments included therein without unacceptably laborious/expensive dismounting operations, which is why it is generally necessary to ultimately discard such material to a waste disposal site. In addition, as a result of metal constructions used in association with arrangements of the above type, the base structures of bristle segments become unacceptably massive, wherefor the coupling and bracing systems included in a sweeping machine must also be of a highly robust design.

Another solution has been disclosed in U.S. Pat. No. 4,236,269, wherein the base element of a vertical axis brush comprises a flat plate structure, which is integrally provided with a coupling system for attaching bristle segments thereto in a snap fit fashion. In this instance, the coupling system consists of clamps formed in the base element, between which the U-shaped bristle segments are attachable. A problem with this type of solution lies particularly in the fact that there is no way of providing a sufficiently reliable clamping for the bristle segments, since no actual locking can be implemented in this discussed solution. For this reason, the positions of bristle segments are also somewhat unstable in the vertical axis brush, firstly as a result of manufacturing tolerances in the bristle segments' U-shape and secondly because the clamps included in the plate or disc are subject to bending in extended use. This aspect in itself is of major importance in terms of holding a vertical axis brush together. Thus, in practice, it is not possible to assemble a sufficiently reliable side brush with the discussed type of solution.

SUMMARY

A side brush adapted to be mounted on a sweeping machine and operative as a brush about a rotation axis according to an embodiment includes a base element and a bristle segment. The base element has at least one outer edge and an elongate channel extending inwardly from a respective outer edge. The bristle segment has a plurality of bristles and a frame member. The frame member has a configuration complementary to a configuration of the elongate channel such that interaction between the frame member and the base element adjacent the elongate channel couples the bristle segment to the base element. Each bristle has a top end, and all of the bristle top ends are fused together to define the frame member.

A side brush adapted to be mounted on a sweeping machine and operative as a brush about a rotation axis according to another embodiment includes a base element and a bristle segment. The base element has an outer edge and an elongate channel extending inwardly from the outer edge. The elongate channel includes a necking adjacent the outer edge. The bristle segment has a plurality of bristles and a frame member. The frame member has a configuration complementary to a configuration of the elongate channel such that interaction between the frame member and the base element adjacent the elongate channel couples the bristle segment to the base element. The bristle segment frame member includes a mating surface arrangement complementary to the necking for locking the bristle segment frame member to the base element.

A side brush adapted to be mounted on a sweeping machine and operative as a brush about a rotation axis according to yet another embodiment includes a base element and a bristle segment. The base element has an outer edge and an elongate channel extending inwardly from the outer edge. The base element defines a recess adjacent the elongate channel. The bristle segment has a plurality of bristles and a frame member. The frame member has a configuration complementary to a configuration of the elongate channel such that interaction between the frame member and the base element adjacent the elongate channel couples the bristle segment to the base element. The bristle segment frame member includes a flange complementary to the recess for locking the bristle segment frame member to the base element.

DETAILED DESCRIPTION

The invention relates to a side brush, which is adapted to be mounted on the body of a sweeping machine, for use as a brush rotatable w about a rotation axis y, and which comprises a base element 1 and a plurality of individual bristle segments 2 detachably mountable thereto, having bristles 2*a*' included therein integrated for a solid unit with a frame member 2*a*" joining the same. The base element 1 comprises a substantially planar disc assembly which is provided integrally with a coupling system for coupling the bristle segments 2 therewith on a snap fit principle. The coupling system is implemented by means of elongated channels U disposed in the base element 1 in a substantially radial direction R and extending through the base element, opening all the way to the edge thereof, which enable coupling the bristle segments 2 immovably to the engagement with the body of a sweeping machine by means of the base element 1 with fasteners 3 interconnecting the same, such as in a screw clamping or suchlike fashion.

Figure 1:
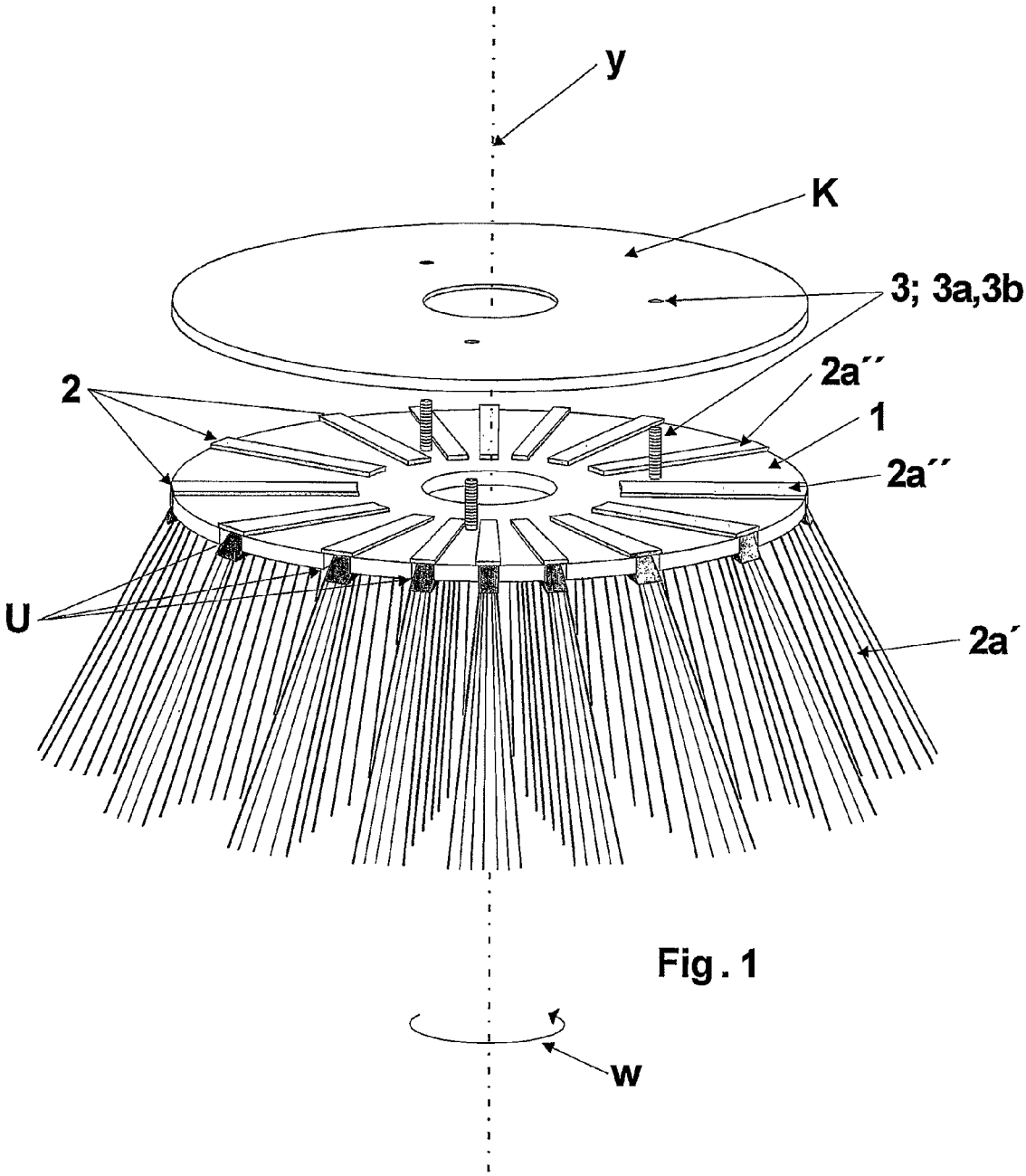
FIG. 1 shows in a perspective view of principle one preferred side brush of the invention, having bristle segments attached thereto.

In reference especially to what is shown in FIG. 1, it is possible to use a side brush of the above type e.g. in such a way that screws 3; 3*b*, fitted in threaded holes 3; 3*a* present in the base element 1 on the body of a sweeping machine or, if necessary, in a separate mounting plate K, are unscrewed such that the base element 1 is able to descend downwards, whereafter the bristle segments 2 are removable one at a time from the channels U, after which, following the installation of new bristle segments, the base element 1 is still attachable by means of the screws 3*b* in its position, such that the back faces of the bristle segments' frame members 2*a*" settle against the body of a sweeping machine/the mounting plate K.

In a preferred embodiment, in reference especially to FIGS. 2*a*, 2*b*, 2*c* and 3, the bristle segments 2 are adapted to be immovably stationary in a plane x of the base element 1 by means of interlocking snap fit arrangements between the frame members 2*a*" thereof and the base element 1, the channels U present in the base element 1 being provided with a necking U1 formed in a radial direction at the base element's 1 outer edge, whereby the bristle segment 2 to be mounted on the base element 1 firstly in a lateral direction by way of an open end of the channel U and secondly from above, is clampable through the intermediary of a mating surface arrangement V present in its frame member 2*a*" whose length L is most preferably at least equal to that of the channel U.

Figure 4A:
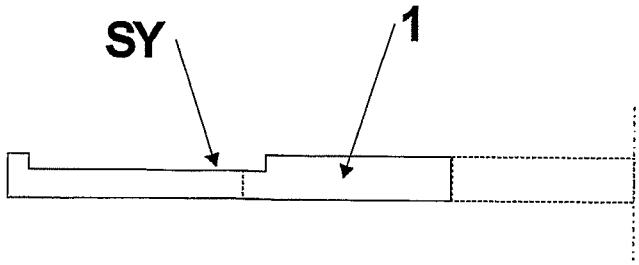
FIGS. 4*a*, 4*b* and 4*c* show one side brush embodiment which is alternative to that shown in FIGS. 1-3, especially with regard to a coupling system, in a halfway cross-section of the base element at its intact portion (FIG. 4*a*), in a halfway cross-section of the base element at a channel fitted with a bristle segment (FIG. 4*b*), and in a detail visualizing the base element in a plan view, one of the channels being fitted with a bristle segment.
Figure 4B:
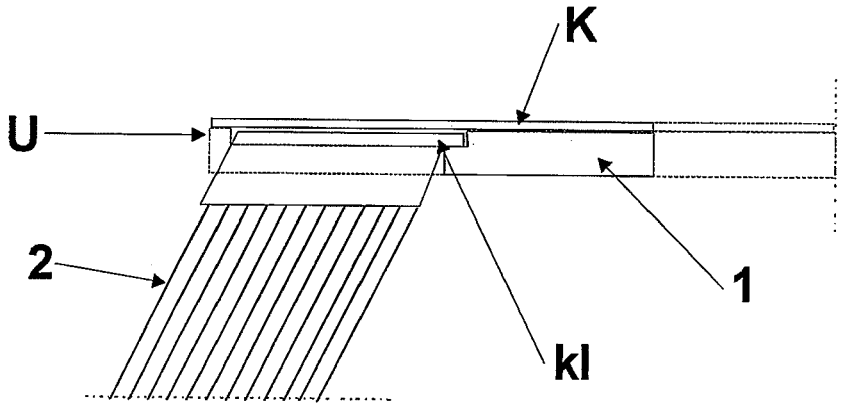
Figure 4C:
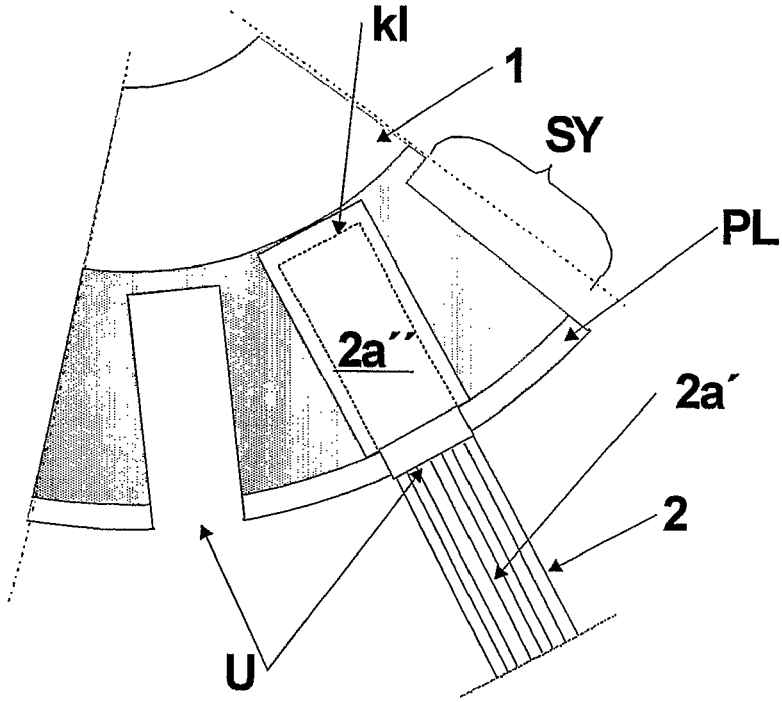
Figure 5:
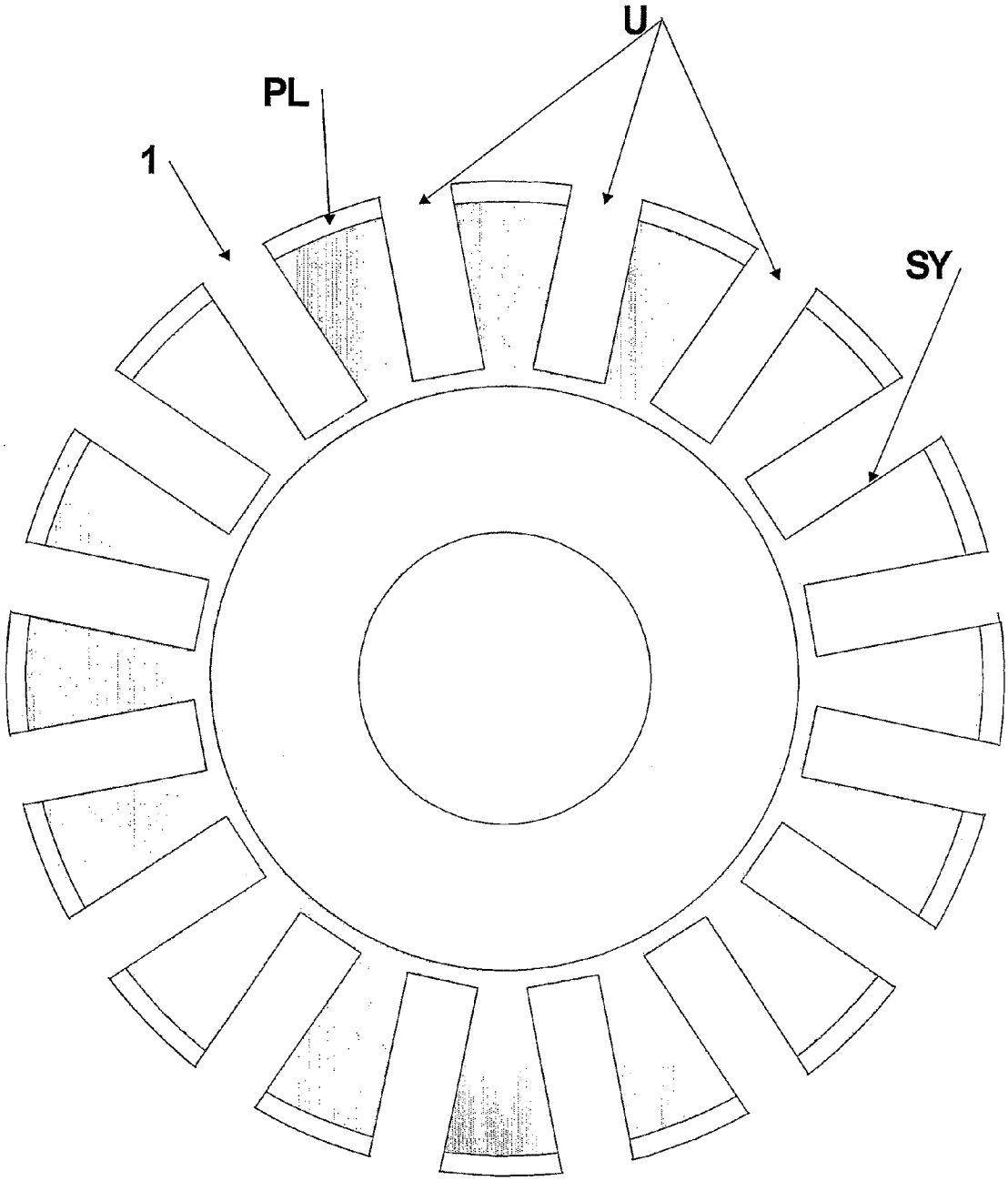
FIG. 5 shows in a plan view a base element included in the side brush shown in FIGS. 4*a*-4*c*, FIGS. 6*a* and 6*b* show one further alternative side brush embodiment, especially with regard to a coupling system, in a halfway cross-sectional view of the base element at its intact portion, and at a channel included in the base element and fitted with a bristle segment.

As a solution alternative to the foregoing, FIGS. 4*a*-4*c* and 5 illustrate an embodiment different from that described above, especially with regard to a coupling system, in the sense that, as shown in FIG. 4*a*, the base element 1 has its top surface provided with a recess arrangement SY for a mounting flange k1 set in the bristle segment's 2 frame member 2*a*", said arrangement extending preferably in a continuous manner along the base element's 1 periphery, as shown in FIGS. 4*c* and 5. In this type of embodiment, the bristle segments 2 can be simply descended into position in each channel U at the above-mentioned recess arrangement SY in such a way that the mounting flanges K1 for said segments' frame members have their ends set against an end flange PL present at the base element's 1 outer edge and constituted by the recess arrangement. Thereafter the side brush is attachable in threaded holes present in the body of a sweeping machine or in a separate mounting plate K, as shown e.g. in FIG. 4*b*, or by means of other such arrangements.

Figure 6A:
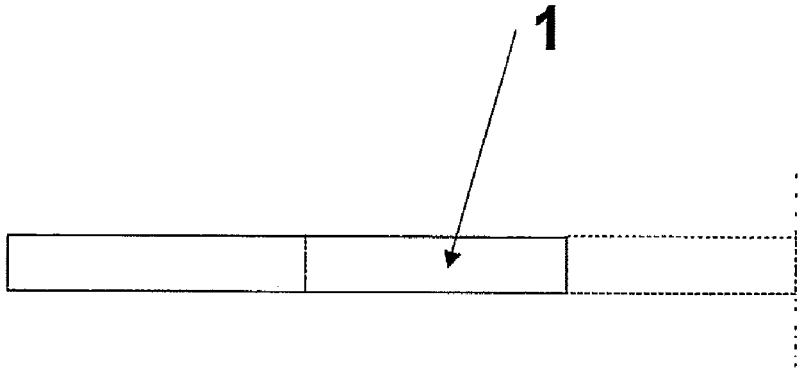
Figure 6B:
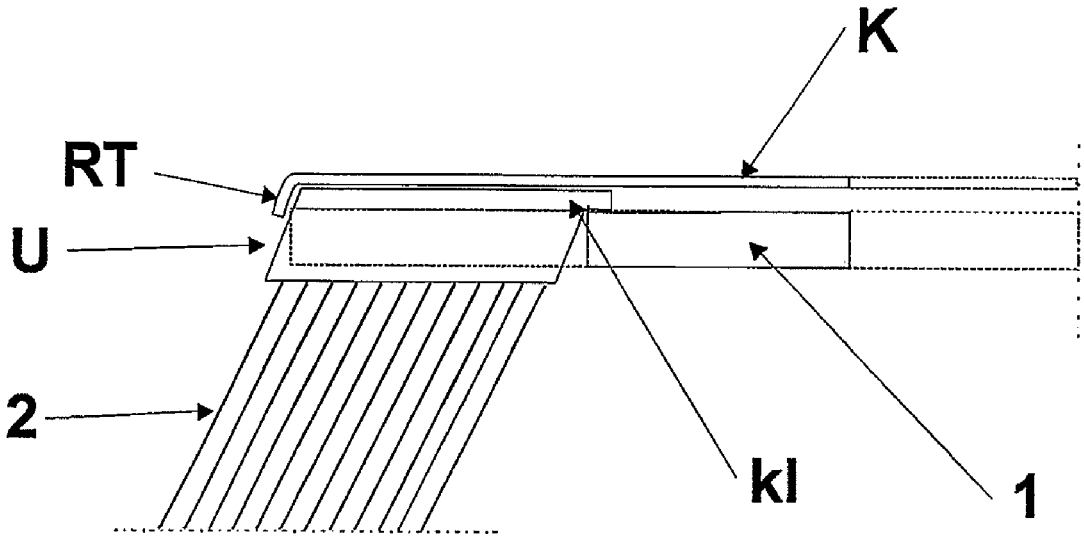
Figure 7:
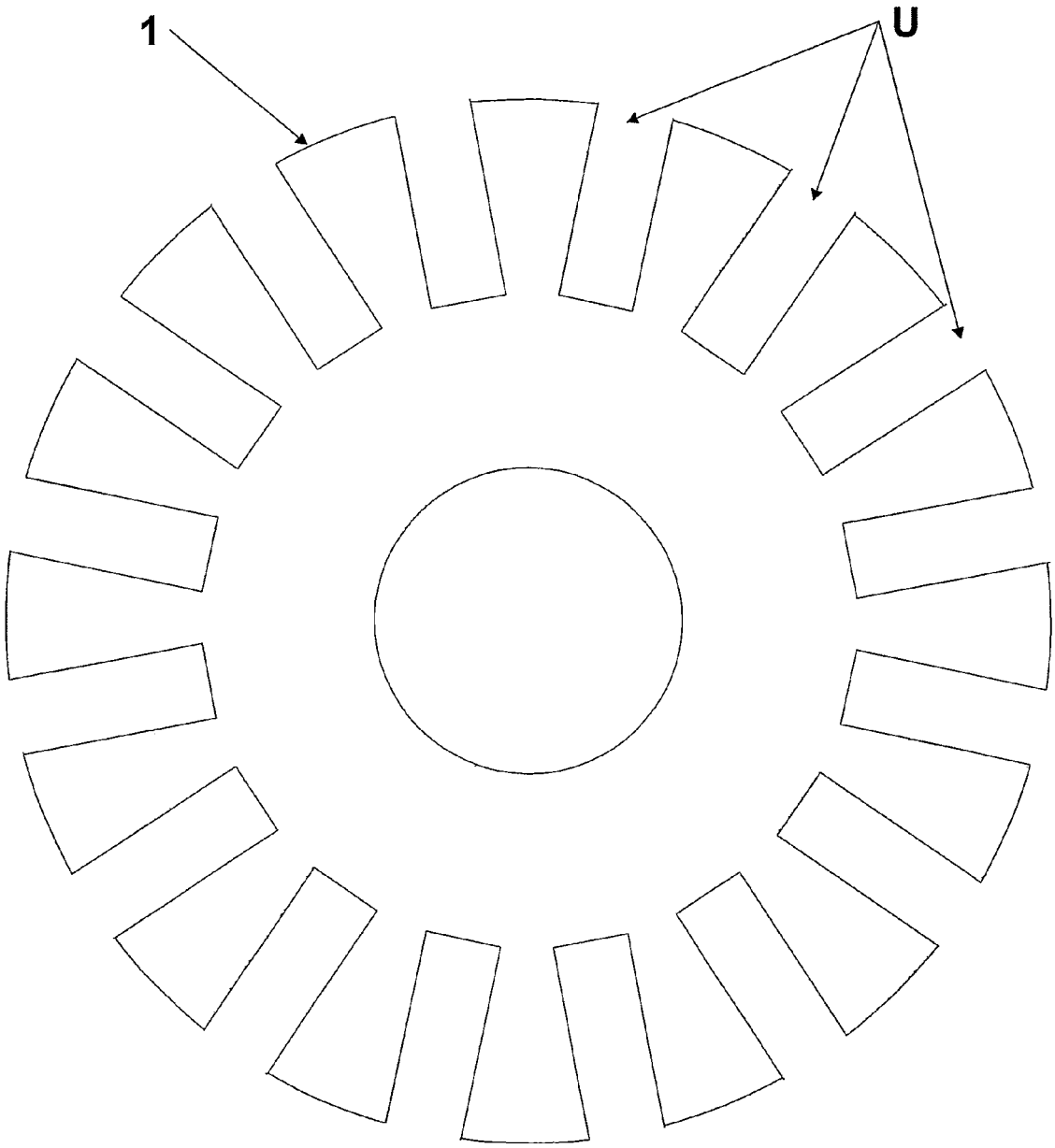
FIG. 7 shows in a plan view a base element used in the embodiment of FIGS. 6*a* and 6*b*, and FIGS. 8*a* and 8*b* show, in an overhead view and a front view, respectively, a bristle segment useful in connection with base elements of the type shown especially in FIGS. 5 and 7.

In a further solution alternative to those described above, FIGS. 6*a*, 6*b* and 7 illustrate a side brush embodiment different from those mentioned above, especially with regard to a coupling system, which is based on fastening the bristle segments 2, as depicted in FIG. 6*b*, by bracing the mounting flange kl present in the segment's frame member 2*a*" against the sides of the channel U present in the base element 1, whereafter the side brush is attachable in threaded holes present in the body of a sweeping machine or, as shown in FIG. 7*b*, in the separate mounting plate K, being supported by a radially directed retaining tab RT included therein.

Figure 8A:
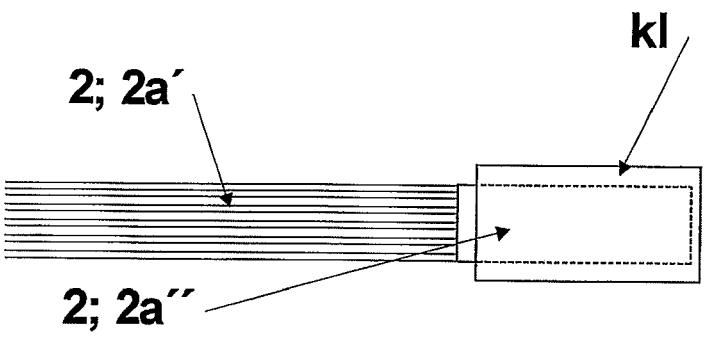
Figure 8B:
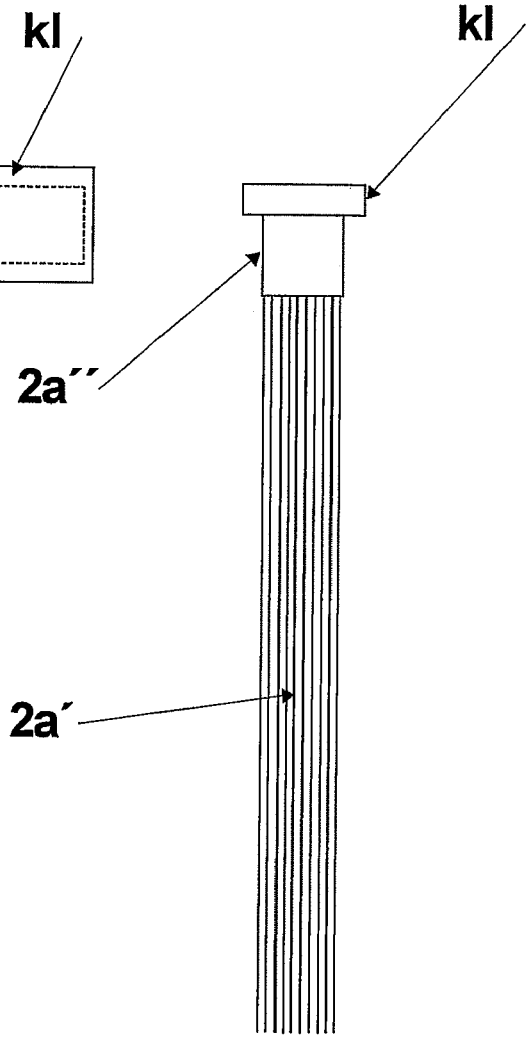

FIGS. 8*a* and 8*b* illustrate in a plan view and in a front view, respectively, a preferred bristle segment 2 useful especially in the base element of a side brush shown in FIG. 5 or 7.

In yet another preferred embodiment, the substantially elongated and rectilinear bristle segment 2 has its frame member 2*a*" composed of a fusion produced from the ends of the bristles 2*a*'.

In a further preferred alternative to the foregoing, the bristle segment 2 has its frame member 2*a*" made of moulded plastics, in which the bristle segment's bristles 2*a*' are anchored by one end thereof during its solidification process.

In a further preferred embodiment alternative to the foregoing, the bristle segment 2 has its frame member 2*a*" manufactured from a chemically solidifying two-component material, such as polyprourethane, epoxy or the like.

Figure 3:
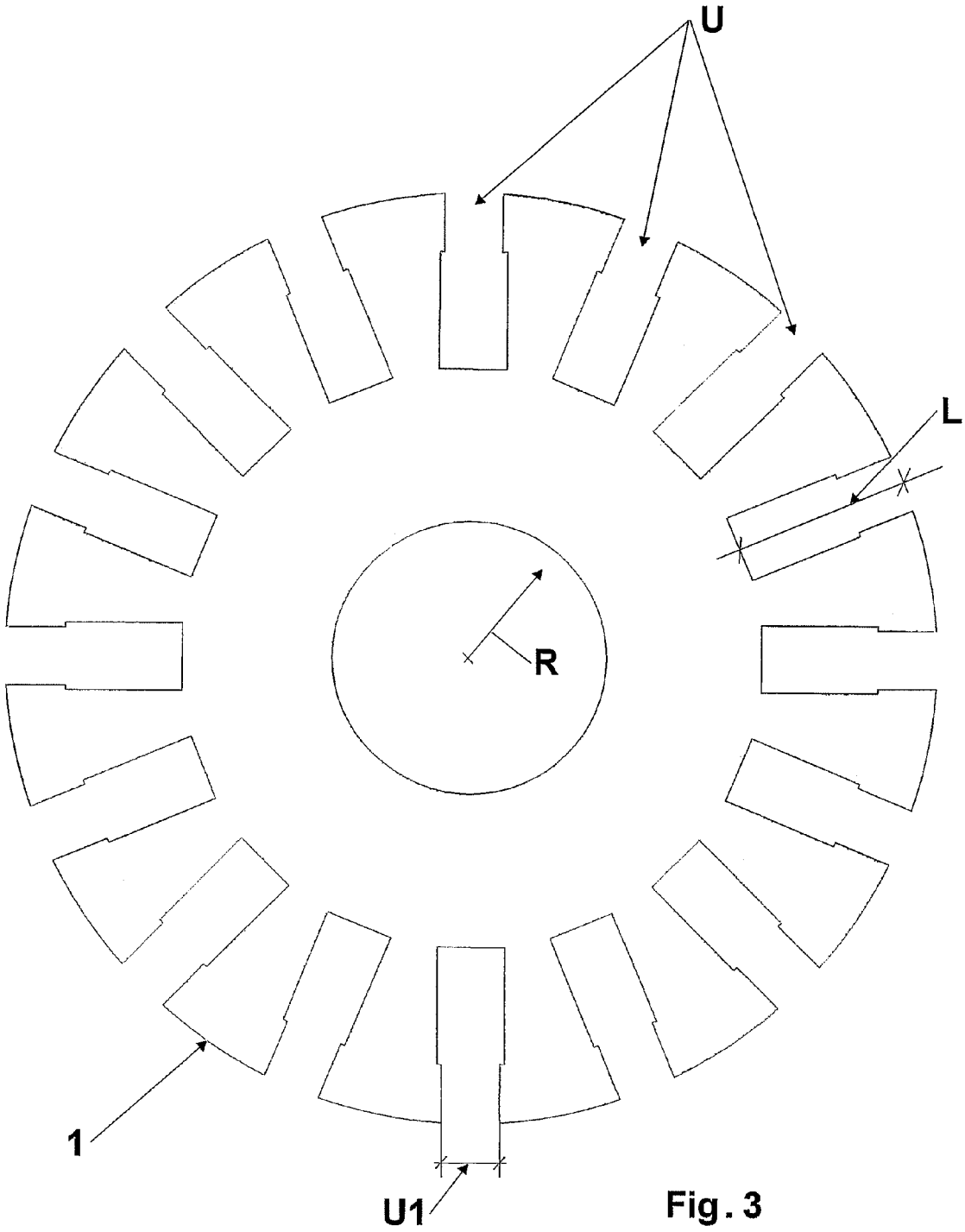
FIG. 3 shows in a plan view one preferred base element included in a side brush of the invention.

On the other hand, the side brush has its base element 1, as shown e.g. in FIGS. 3, 5 or 7, manufactured from a substantially rigid-structured plastic, metal, ceramic, composite material and/or the like.

In further reference to preferred embodiments as shown especially in FIGS. 1, 2*a*, 4*b* or 6*b*, the bristle segment 2 has its bristles 2*a*' arranged at an angle a relative to the frame member 2*a*", deviating substantially from a perpendicular direction.

In a further preferred embodiment, one or more bristle segments 2 of the side brush are provided with bristles 2*a*' manufactured from a plastic-based material, such as polypropylene, polyamide or the like.

Figure 2C:
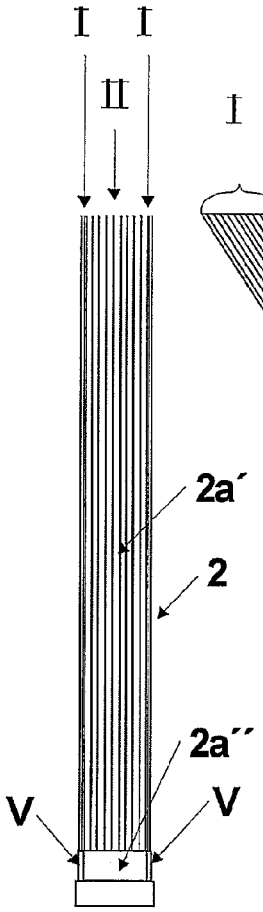
FIGS. 2*a*, 2*b* and 2*c* show one side brush of the invention in a cross-section along its center line (FIG. 2*a*) and a bristle segment included therein, in a plan view (FIG. 2*b*) and in a front view (FIG. 2*c*)
Figure 2A:
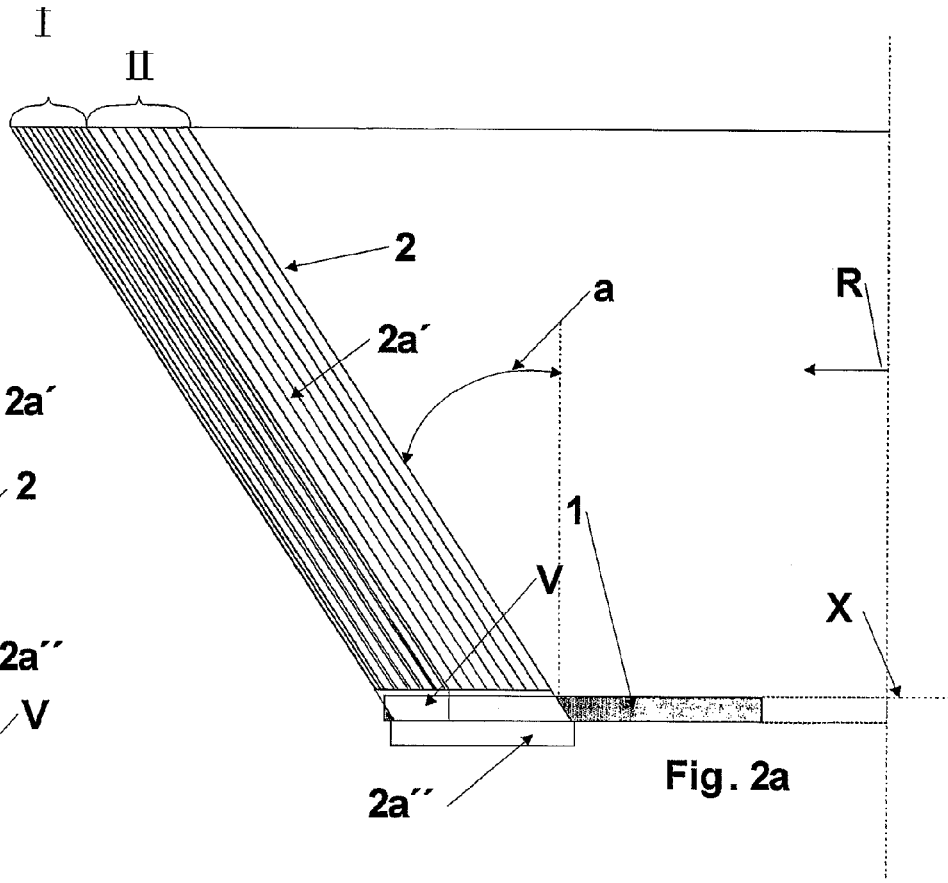
Figure 2B:
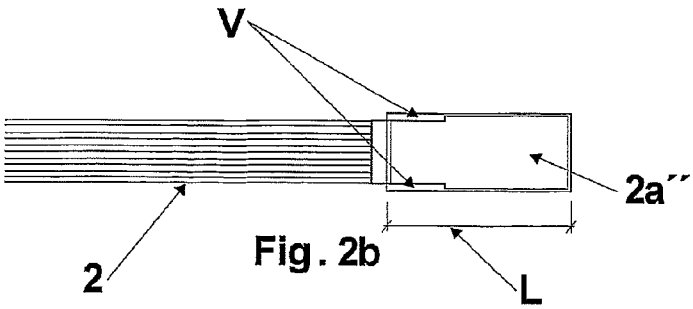

In further reference especially to what is shown in FIGS. 2*a* and 2*c*, the bristle segment 2 has its bristles 2*a*' in zones I and II composed of at least two types of plastic bristles cross-sectionally substantially different from each other, which makes it especially possible to improve rigidity of the bristle segments' 2 bristles without using traditional steel bristles. Thus, it is possible to place plastic bristles of different thicknesses as shown for example in FIG. 2*a*, such that the stronger bristles are located at the outer end of a bristle segment, as viewed in a radial direction R, or else, as shown in FIG. 2*c*, such that the stronger bristles are located on the opposite sides of a bristle segment.

On the other hand, in a solution alternative or complementary to the foregoing, it is possible to provide one or more bristle segments 2 of the side brush with bristles manufactured, as mentioned above, from a metal material, such as steel.

It is obvious that the invention is not limited to the embodiments illustrated or described above, but it can be modified according to varying demands and operating conditions without departing from the basic inventive concept. Hence, it should be appreciated in the first place that the configuration of a base element may differ from what is described above, depending on its currently applied coupling with the brush body of a sweeping machine. Secondly, its dimensions and appearance are naturally subject to variations, depending on the dimensions of each manufactured cassette brush and a material used therefor. On the other hand, it is naturally also possible to provide the side brush with a brush pattern extending along the periphery of the side brush in a more discontinuous way than what is shown in the figures. Naturally, it is also clear that the coupling system may consist of mating surfaces with a wide variety of cross-sections, contours, and functions for achieving the locking of bristle segments to a base element.

What is claimed is:

1. A side brush adapted to be mounted on a sweeping machine and operative as a brush about a rotation axis, the side brush comprising:

a base element having at least one outer edge and an elongate channel extending inwardly from a respective outer edge; and a bristle segment having a plurality of bristles and a frame member, the frame member having a configuration complementary to a configuration of the elongate channel such that interaction between the frame member and the base element adjacent the elongate channel couples the bristle segment to the base element;

wherein each bristle has a top end and a plurality of the bristle top ends are fused together to define the frame member; and wherein the elongate channel is more narrow at the respective outer edge than at a position inward from the respective outer edge.

2. A side brush adapted to be mounted on a sweeping machine and operative as a brush about a rotation axis, the side brush comprising:

a base element having at least one outer edge and an elongate channel extending inwardly from a respective outer edge; and a bristle segment having a plurality of bristles and a frame member, the frame member having a configuration complementary to a configuration of the elongate channel such that interaction between the frame member and the base element adjacent the elongate channel couples the bristle segment to the base element;

wherein each bristle has a top end and a plurality of the bristle top ends are fused together to define the frame member;

wherein the elongate channel includes a necking adjacent the respective outer edge; and wherein the bristle segment frame member includes a mating surface arrangement complementary to the necking for locking the bristle segment frame member to the base element.

3. A side brush adapted to be mounted on a sweeping machine and operative as a brush about a rotation axis, the side brush comprising:

a base element having at least one outer edge and an elongate channel extending inwardly from a respective outer edge; and a bristle segment having a plurality of bristles and a frame member, the frame member having a configuration complementary to a configuration of the elongate channel such that interaction between the frame member and the base element adjacent the elongate channel couples the bristle segment to the base element;

wherein each bristle has a top end and a plurality of the bristle top ends are fused together to define the frame member;

wherein the base element defines a recess adjacent the elongate channel; and wherein the bristle segment frame member includes a flange complementary to the recess for locking the bristle segment frame member to the base element.

4. The side brush of claim 3, wherein the base element recess is spaced apart from the at least one outer edge.

5. A side brush adapted to be mounted on a sweeping machine and operative as a brush about a rotation axis, the side brush comprising:

a base element having at least one outer edge and an elongate channel extending inwardly from a respective outer edge; and a bristle segment having a plurality of bristles and a frame member, the frame member having a configuration complementary to a configuration of the elongate channel such that interaction between the frame member and the base element adjacent the elongate channel couples the bristle segment to the base element;

wherein each bristle has a top end and a plurality of the bristle top ends are fused together to define the frame member;

wherein the base element defines a recess adjacent the elongate channel;

wherein the bristle segment frame member includes a flange complementary to the recess; and wherein the flange is seated in the recess to lock the bristle segment frame member to the base element.

6. The side brush of claim 5, wherein the base element is generally circular.

7. A side brush adapted to be mounted on a sweeping machine and operative as a brush about a rotation axis, the side brush comprising:

a base element having at least one outer edge and an elongate channel extending inwardly from a respective outer edge; and a bristle segment having a plurality of bristles and a frame member, the frame member having a configuration complementary to a configuration of the elongate channel such that interaction between the frame member and the base element adjacent the elongate channel couples the bristle segment to the base element;

wherein each bristle has a top end and a plurality of the bristle top ends are fused together to define the frame member; and wherein the bristles are angled relative to the frame member.

8. A side brush adapted to be mounted on a sweeping machine and operative as a brush about a rotation axis, the side brush comprising:

a base element having an outer edge and an elongate channel extending inwardly from the outer edge, the elongate channel including a necking adjacent the respective outer edge; and a bristle segment having a plurality of bristles and a frame member, the frame member having a configuration complementary to a configuration of the elongate channel such that interaction between the frame member and the base element adjacent the elongate channel couples the bristle segment to the base element;

wherein the bristle segment frame member includes a mating surface arrangement complementary to the necking for locking the bristle segment frame member to the base element.

9. The side brush of claim 8, wherein each bristle has a top end and a plurality of the bristle top ends are fused together to define the frame member.

10. The side brush of claim 8, wherein a plurality of the bristles respectively have an end anchored to the frame member during solidification.

11. The side brush of claim 8, wherein the bristles are manufactured from at least one of metal or plastic.

12. The side brush of claim 8, wherein:

the base element defines a recess adjacent the elongate channel; and the bristle segment frame member includes a flange complementary to the recess for locking the bristle segment frame member to the base element.

13. The side brush of claim 12, wherein:

the base element recess is spaced apart from the outer edge; and the flange is seated in the base element recess to lock the bristle segment frame member to the base element.

14. A side brush adapted to be mounted on a sweeping machine and operative as a brush about a rotation axis, the side brush comprising:

a base element having an outer edge and an elongate channel extending inwardly from the outer edge, the base element defining a recess adjacent the elongate channel; and a bristle segment having a plurality of bristles and a frame member, the frame member having a configuration complementary to a configuration of the elongate channel such that interaction between the frame member and the base element adjacent the elongate channel couples the bristle segment to the base element;

wherein the bristle segment frame member includes a flange complementary to the recess for locking the bristle segment frame member to the base element.

15. The side brush of claim 14, wherein the base element recess is spaced apart from the outer edge.

16. The side brush of claim 14, wherein the flange is seated in the recess to lock the bristle segment frame member to the base element.

17. The side brush of claim 14, wherein each bristle has a top end and a plurality of the bristle top ends are fused together to define the frame member.

18. The side brush of claim 14, wherein a plurality of the bristles respectively have an end anchored to the frame member during solidification.

19. The side brush of claim 14, wherein the bristles are manufactured from at least one of metal or plastic.

* * * * *